United States Patent [19]

Boyce

[11] 4,173,240

[45] Nov. 6, 1979

[54] LUMBER CUTTING ATTACHMENTS FOR CHAIN SAWS

[76] Inventor: Oren D. Boyce, 406 S. Chester St., Gastonia, N.C. 28052

[21] Appl. No.: 923,774

[22] Filed: Jul. 12, 1978

[51] Int. Cl.[2] ..... B27B 1/00; B27B 17/02

[52] U.S. Cl. ..... 144/312; 30/371; 83/745; 30/373; 144/136 R; 144/326 R

[58] Field of Search ..... 30/371, 372, 374, 373, 30/381; 144/312, 136 R, 326 R, 136 C; 83/574, 745

[56] References Cited

U.S. PATENT DOCUMENTS

| | | | |
|---|---|---|---|
| 3,051,203 | 8/1962 | Hayden | 30/371 X |
| 3,092,156 | 6/1963 | Hayden | 30/371 |
| 3,134,409 | 5/1964 | Hayden | 30/371 |
| 3,225,799 | 12/1965 | Hayden | 30/371 |
| 3,262,475 | 7/1966 | Sweet | 144/312 X |
| 3,434,514 | 3/1969 | McManama | 144/312 X |
| 3,969,788 | 6/1976 | Granberg | 83/745 |
| 4,070,757 | 1/1978 | Granberg et al. | 83/745 X |
| 4,122,604 | 10/1978 | Brown | 30/371 |
| 4,134,203 | 1/1979 | Grube | 30/371 |

*Primary Examiner*—Jimmy C. Peters
*Attorney, Agent, or Firm*—Clifton T. Hunt, Jr.

[57] ABSTRACT

Lumber cutting attachments for use with a portable chain saw comprising a depth gauge or tip bracket for making a preliminary guide channel longitudinally of a lot to be cut into lumber, a stabilizing bracket including means for following the guide channel and directing the saw chain into the channel, and a guide bracket for cutting lengths of lumber of a desired width. The invention includes the method of cutting straight lengths of lumber from a log with a chain saw utilizing a chalk line to delineate the path of the guide channel.

12 Claims, 23 Drawing Figures

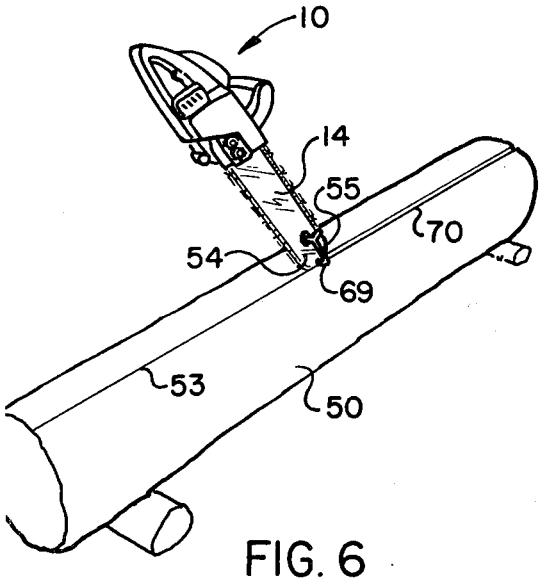
FIG. 6
FIG. 11
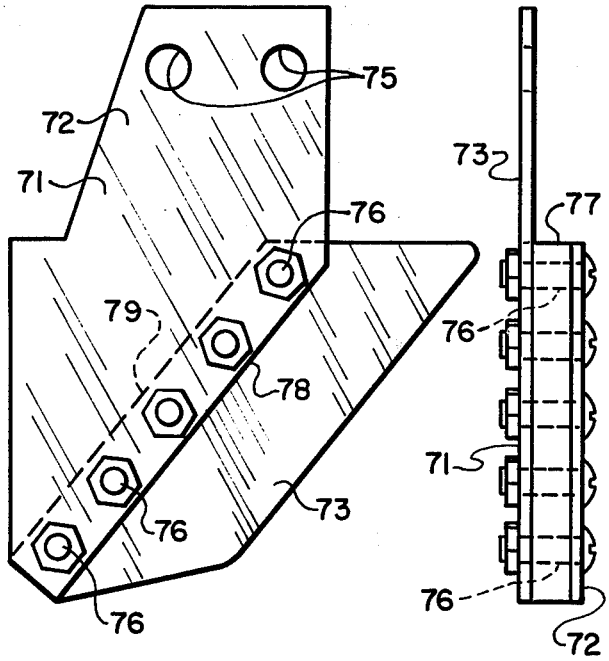
FIG. 12
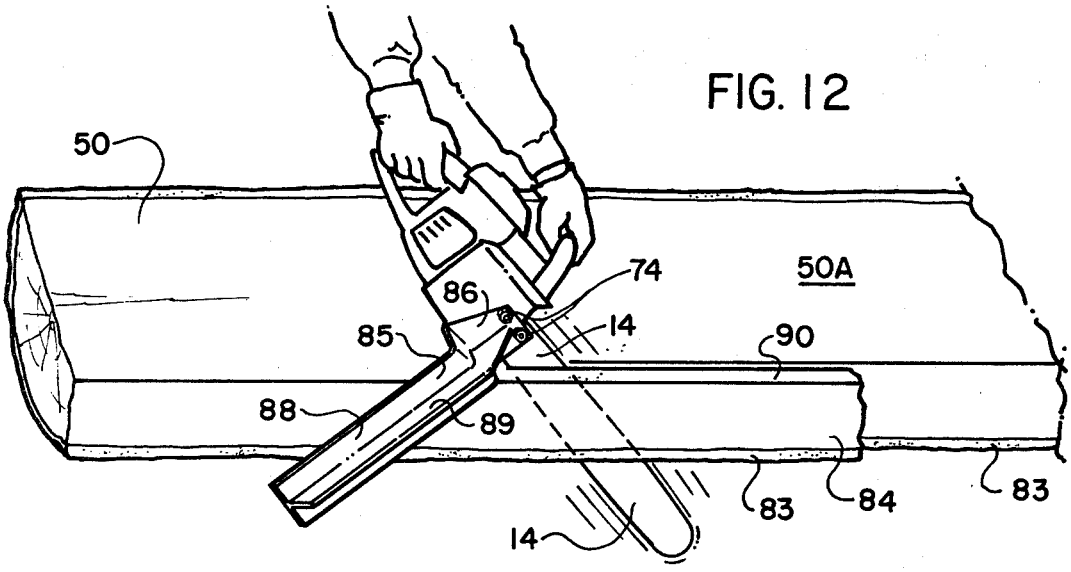

FIG. 16A
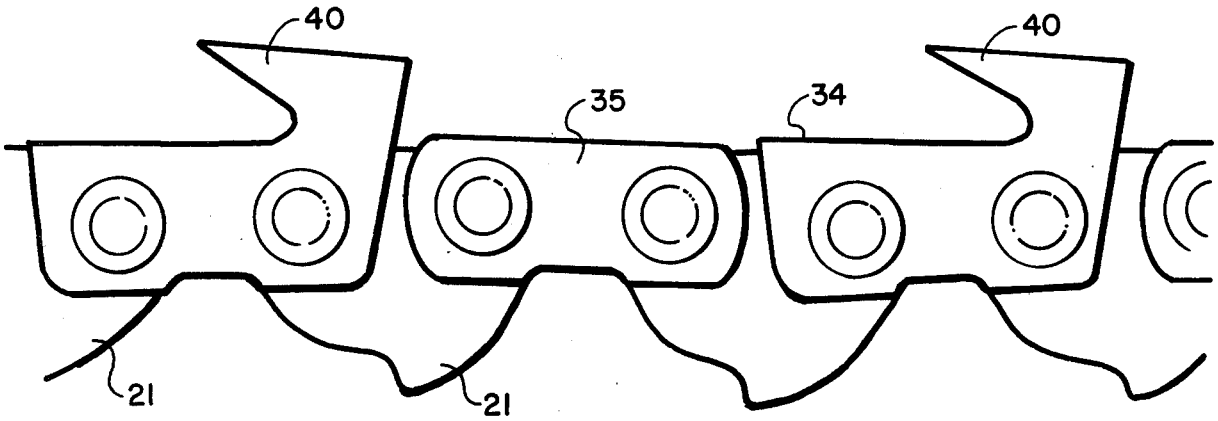
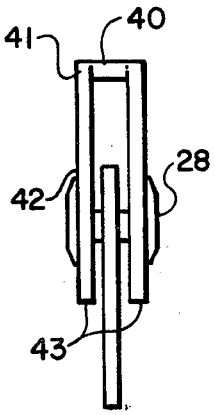
FIG. 16B
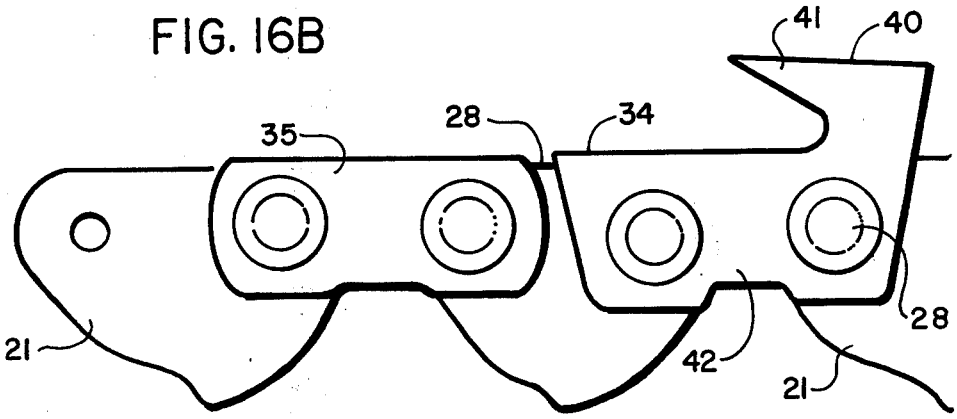
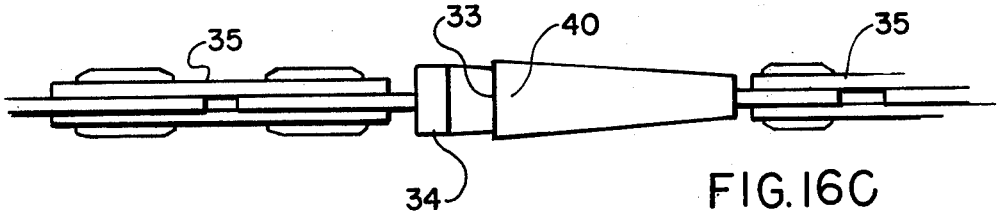
FIG. 16C

LUMBER CUTTING ATTACHMENTS FOR CHAIN SAWS

DESCRIPTION

BACKGROUND OF THE INVENTION

Various attachments and guides have been provided in the prior art to enable portable chain saws to cut boards and lumber from logs without the use of a sawmill. It is an object of the present invention to overcome difficulties encountered with the prior art attachments and guides.

U.S. Pat. Nos. 3,051,203 and 3,225,799 to Ernest A. Hayden show two types of attachments which use rollers and wheels which cooperate with a guide nailed to the top of a log for guiding movement of the chain saw. Attachments of this type are expensive because of the guide rollers and bearings required and have proved to be awkward and unsatisfactory in use because of the problem caused by chips and sawdust which get between the rollers and the guiding surface of the log which causes irregular cuts and a consequent uneven surface on the cut lumber.

U.S. Pat. No. 3,864,830 to Jesse E. Haden and U.S. Pat. No. 4,070,757 to Elof Granberg et al disclose attachments for adapting chain saws to cut lumber from logs. Both of these examples of the prior art rely on a guide such as a two-by-four board nailed to the log to the cut and along which the chain saw traverses in making the initial cut in the log. This is objectional because the operator must necessarily have a long straight board in addition to the attachments connected to the saw bar of the chain saw. In both Haden and Granberg the attachments are clamped to the saw bar as opposed to being rigidly connected as by bolts. The clamping of the attachments to the saw bar as disclosed in Haden and Granberg is hazardous because the vibration of the chain saw tends to loosen the clamping mechanism and the rapidly rotating saw chain may be accidently moved against the metal attachments causing flying shrapnel and consequent danger of injury or death.

U.S. Pat. No. 3,965,788 to Elof Granberg discloses a lumber making attachment for a portable chain saw which is also attached as by clamping to the saw bar of the chain saw and also relies on the attachment of a guide directly to the log to make the first cut in the log. The Granberg disclosure is objectionable for the reasons previously given.

SUMMARY OF THE INVENTION

According to the present invention it is not necessary to attach a guide directly to the log before making the first cut. A straight line is made on the log by the use of a chalk line held against opposite ends of the log and snapped against the log surface to leave a visible mark in a well known manner. Next, a tip bracket or depth gauge is attached to the free end of the saw bar as by a bolt extending through the saw bar and by one leg of the bracket extending through an adjacent passage in the saw bar. The tip bracket may be readily installed and removed by manipulation of a single thumb screw. The surface of the tip bracket closest to the free end of the saw bar is spaced inwardly from the tip of the saw bar about 5 centimeters and extends laterally of the saw bar to provide a support for the chain saw.

Along the mark made by the chalk line the operator begins at one end of the log marked with the chalk line and positions the laterally projecting part of the tip bracket or depth gauge on the surface of the log with the saw chain on the line made along the log. The operator draws the chain saw along the line with the depth gauge resting on the surface of the log to make a groove in the log about 5 centimeters deep coinciding with the chalk line. If several logs are to be cut into lumber the operator then moves to the next log and after it is marked with a chalk line it is grooved in the same manner.

After all the logs to be cut into lumber have been grooved in the manner described, the tip bracket is removed from the saw bar and a stabilizing bracket is attached to the housing of the chain saw by the same bolts which connect the saw bar to the housing. The stabilizing bracket includes an elongated narrow guide finger that fits within the groove or guide channel. With the guide finger in the guide channel the chain saw is drawn along the length of the log to split it in half.

The chalk line is again employed to make a visible mark on a split surface of the log any desired distance from a longitudinal edge of the split log. The tip bracket is reassembled on the free end of the saw bar and the split surface of the log is grooved in the same manner as the uncut log was originally grooved. The tip bracke is removed and the stabilizing bracket is employed to guide the saw along the guide channel to cut the first slab. This provides a square edge on the log and the stabilizing bracket is replaced by a guide bracket which is also attached to the housing with the same bolts that connect the saw bar to the housing. The guide bracket includes a depending guide leg offset from the saw bar the desired thickness of the board to be cut from the log. The guide leg is moved along the square edge and the saw chain cuts a board from the log of the desired thickness. The guide leg may be adjustable to positions variably spaced from the saw bar.

It is an object of this invention to provide attachments for a chain saw which are small and easily carried into the woods with the chain saw and which enable the chain saw and the brackets of this invention to cut straight lengths of lumber from logs without any extraneous guide other than a chalk line.

It is another object of this invention to provide means for forming a straight guide channel longitudinally of a log as a preliminary step to cutting straight lengths of lumber from the log.

It is another object of this invention to provide a novel method of cutting lumber from logs, which method includes the novel step of forming a guide channel in the log preparatory to cutting lumber therefrom.

BRIEF DESCRIPTION OF THE DRAWINGS

Some of the objects of the invention having been stated other objects will appear as the description proceeds when taken in connection with the accompanying drawings, in which:

FIG. 6 is a perspective view of the chain saw equipped with the tip bracket and following the chalk line while cutting the guide groove or channel;

FIG. 11 is a side elevation and end elevation of the stabilizing bracket or stabilizer;

FIG. 12 is a perspective view illustrating the use of a guide bracket to cut a board from the log of FIG. 6 after a square edge was obtained by use of the stabilizing bracket as shown in FIG. 10;

FIGS. 16A, 16B and 16C are, respectively, a fragmentary side elevation, with parts broken away, of a modified saw chain; a combined fragmentary side elevation and perspective view of the modified chain, and a fragmentary top plan view of the modified chain.

DETAILED DESCRIPTION OF THE INVENTION

Figure 1:
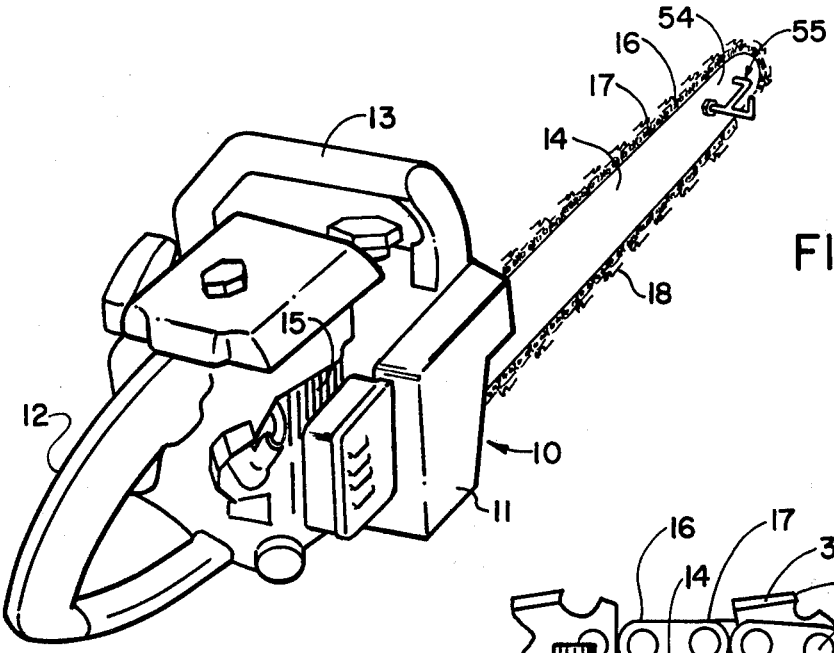
FIG. 1 is a perspective view of a chain saw illustrating the attachment of the tip bracket to the tip end of the saw bar.

Referring more specifically to the drawings, the numeral 10 broadly indicates a portable chain saw comprising a body portion or housing 11 from which extend handles 12 and 13 and a saw bar 14. An engine 15 is mounted in the housing 11 and propels a saw chain 16 in two flights 17 and 18 about the peripheral edges of the saw bar 14.

The apparatus thus far described is conventional and is widely used in the felling of trees. For example, it may be a type manufactured by Homelite Division of Textron, Inc. near Charlotte, N.C., and sold under the trademark HOMELITE.

The felling of trees generally involves cutting across the grain of the wood and for this reason the cutting teeth on the prior art saw chains generally have a pointed configuration which is appropriate for cutting across the grain of the wood.

Figure 3:
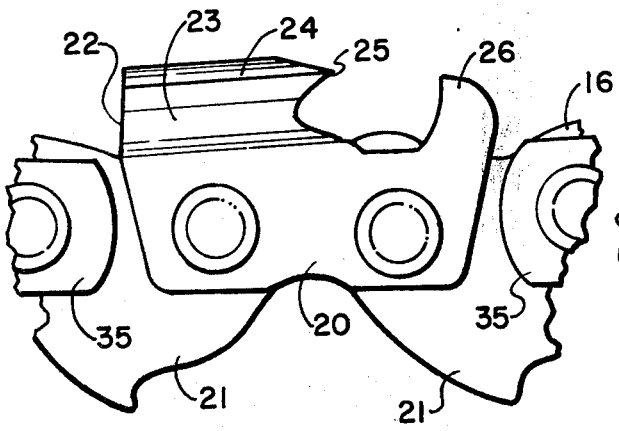
FIG. 3(PRIOR ART)
FIG. 3 is an enlarged fragmentary view with parts broken away of the saw chain illustrating the guide tooth and cutting tooth of the prior art.

Referring to FIG. 3, a prior art cutter link 20 is shown pivotally connected to alternately arranged sprocket links 21. The cutter link 20 includes a cutter tooth 22 having a rounded side wall 23, a flat top wall 24 and a pointed leading end 25. The cutter line 20 also includes a guide tooth 26 which serves to guide the cutter tooth 25 into the kerf made by the immediately preceding cutter tooth, not shown.

Figure 3A:
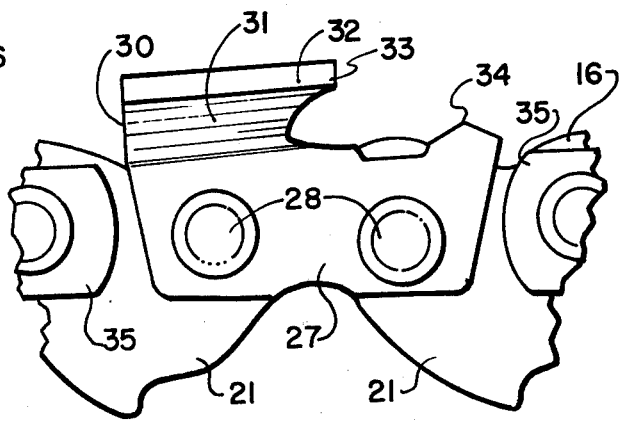
FIG. 3A is a view similar to FIG. 3 but showing the guide tooth and cutting tooth as modified in accordance with the invention.

The present invention is concerned with the cutting of lumber from logs and in most instances this involves cutting the log longitudinally of its axis. It is desirable to modify the conventional saw chain of FIG. 3 to provide teeth having a configuration suitable for cutting with the grain of the wood or ripping. FIG. 3A shows a cutter link 27 pivotally connected as at 28 to adjacent sprocket links 21, which are identical to the prior art sprocket links. The cutter link 27 includes a cutter tooth 30 having a rounded side wall 31, a flat top wall 32 and a straight or chisel shaped leading edge 33. The prior art guide tooth 26 is omitted or substantially filed away leaving a reduced forward portion on the cutter link 27 as shown at 34 in FIG. 3A.

In both the prior art saw chain of FIG. 3 and the saw chain of the present invention as illustrated in FIG. 3A the cutter links 20 or 27 are alternately arranged with spacer links 35 pivotally connected to adjacent sprocket links 21.

Referring to FIGS. 16A, 16B and 16C, a modified cutter tooth is shown at 40 which differs from the cutter tooth 30 of FIG. 3A in that the cutter tooth 30 of FIG. 3A is of generally L-shaped configuration in cross section with the rounded side wall 31 forming one leg and the flat top wall 32 forming the other leg. The tooth 40 in FIG. 16A–16C is as most clearly seen in the perspective showing of tooth 40 at the left of FIG. 16B made of solid construction throughout the cutting portion of the tooth indicated at 41 and of U-shaped configuration at the lower or joining portion of the tooth indicated at 42 to define legs 43 which straddle a sprocket line 21 and are connected thereto by a pin 28. Otherwise, the teeth 30 and 40 are alike in that tooth 40 also includes a straight chisel shaped leading edge 33 which serves as a cutting surface and the guide tooth is omitted or filed away to leave a reduced leading portion as indicated at 34. Like parts bear like reference characters in FIGS. 3A and 16A–16C.

The invention also includes improved means and method for utilizing the cutter teeth arranged for ripping in an efficient manner to form lumber from logs with a chain saw of generally conventional construction. According to the invention, after a tree is felled and the branches have been removed with a chain saw in the usual manner the remaining log may be cut into lumber on the site without moving the log to a sawmill.

Figure 5:
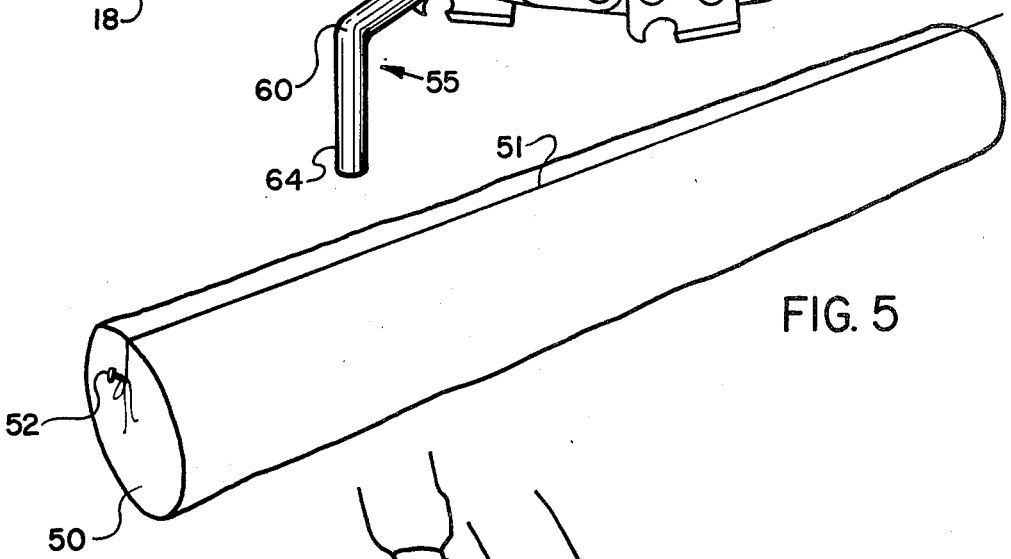
FIG. 5 is a perspective view of an uncut log with a chalk line positioned on it to mark the path of the guide channel.

The steps of the novel method of cutting lumber from a log with a chain saw comprises first utilizing a chalk line stretched between opposite ends of the log to leave a visible mark on the log thereby designating a path of cut to be made in the log. In FIG. 5 a log 50 has a chalk line 51 stretched between opposite ends of the log to define a straight line. The line may be held taut manually or by laying other logs on the line stretched on the log to be cut, or by nails 52 to hold the chalk line 51 in taut condition. As is well known the chalk line is simply a string coated with chalk dust and it makes a convenient straight line along the log 50 when the chalk line 51 is manually pulled away from the log at its medial portion and then allowed to snap back against the surface of the log. This impact causes the chalk dust to separate from the chalk line and mark the surface of the log in a straight line as indicated at 53 in FIG. 6. The line 53 extends between the ends of the log 50 when the chalk line 51 is snapped against the surface of the log as explained.

The line 53 indicates the path of cut for the next step in cutting lumber from the log 50, which is to make a guide groove or channel along the straight line 53. This is accomplished according to the invention by equipping the tip end portion 54 of saw bar 14 with a tip bracket generally indicated at 55 in FIGS. 1, 2, 4 and 9. The tip bracket 55 may be mounted to the tip end 54 of saw bar 14 by providing two bores 56 and 57 (FIG. 4) in the tip end 54 of saw bar 14. The tip bracket comprises a first L-shaped portion 60 having a leg 61 which terminates in a threaded end portion 62 and has a nut 63 fully seated on the threaded end portion 62. The other leg 64 of L-shaped member 60 selectively extends downwardly laterally from the saw bar 14 in fixed spaced relation thereto to serve as a forward spacer bracket when desired. Arranged in this position the threaded end portion 62 extends through bore 57 in saw bar 14 and is held therein by thumb screw 65 fastened on threaded end portion 62 snugly against the opposite surface of saw bar 14.

Figure 4:
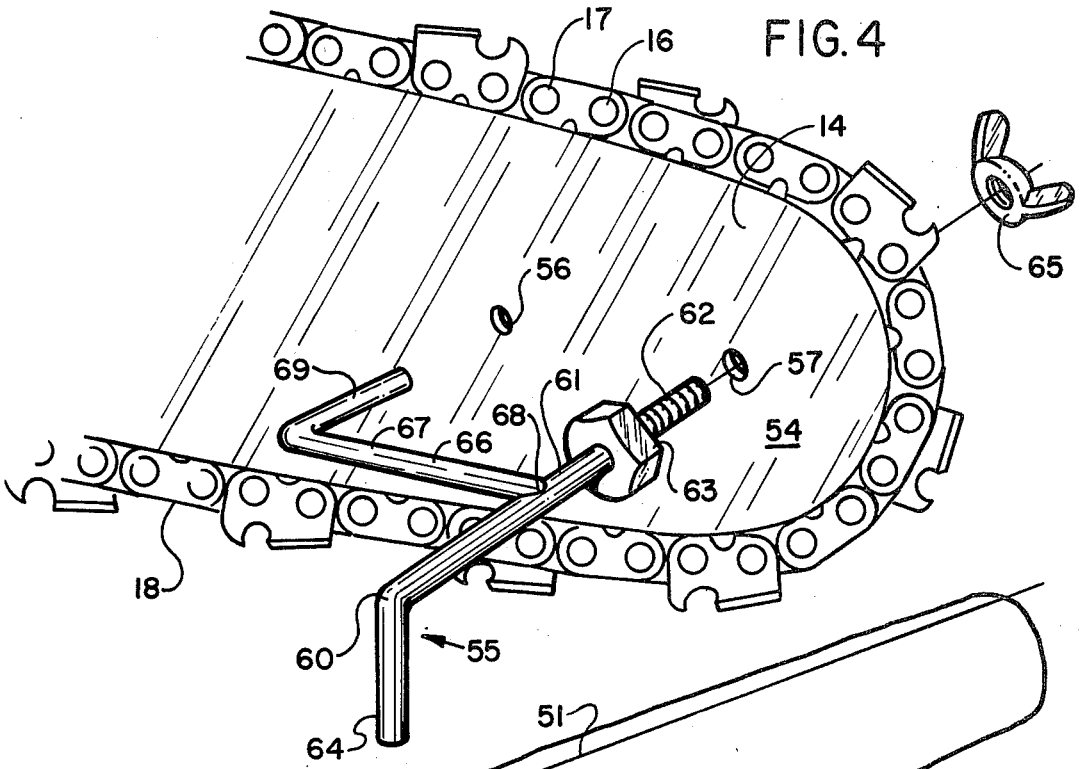
FIG. 4 is a fragmentary exploded view of the tip end portion of the saw bar illustrating how the tip bracket may be alternatively attached to the saw bar to function as a lateral spacer instead of a depth gauge.

A second L-shaped member 66 has one leg 67 fixed as by welding at 68 to leg 61 of bracket 60 between leg 64 and nut 63 (FIG. 4). L-shaped member 66 includes a second leg 69 extending in right angular relation to leg 67 and received within bore 56 in saw bar 14 when tip bracket 55 is attached to saw bar 14 to utilize the spacer bracket 64.

Figure 2:
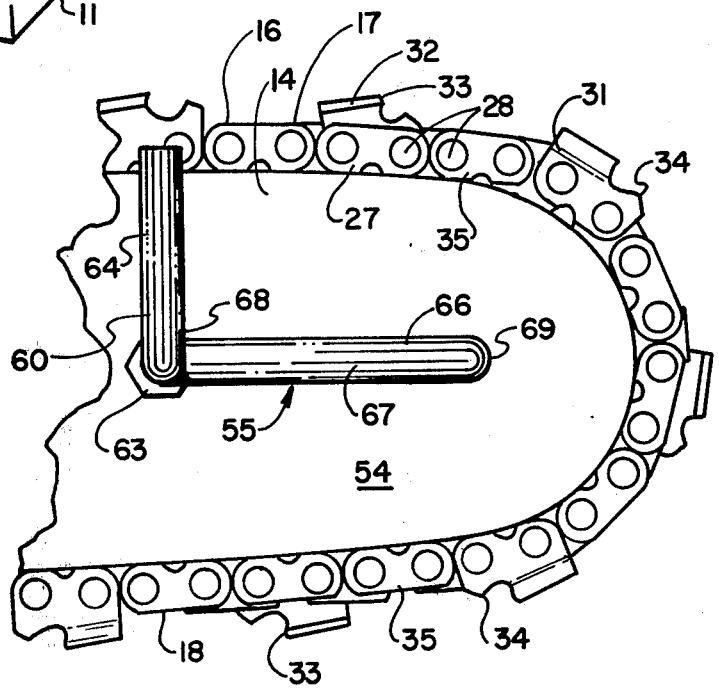
FIG. 2 is an enlarged fragmentary side elevation of the tip end of the saw bar with parts broken away and illustrating the attachment of the tip bracket.

When it is desired to employ tip bracket 55 to limit the depth of cut (FIG. 2) the threaded end portion 62 is removed from bore 57 by loosening thumb screw 65 and tip bracket 55 is relocated relative to saw bar 14 with the threaded end portion 62 penetrating bore 56 and with the leg 69 penetrating the forward bore 57. Thus, as shown in FIG. 2 the leg 64 on L-shaped member 60 extends upwardly and the leg 69 extends horizontally from foward bore 57. The leg 69 of tip bracket 55 rides along the surface of the log when the tip 54 of saw bar 14 is pushed into the log 50 along the chalk line 53 to cut a guide channel 70. The chain saw 10 is drawn the full length of log 50 with the tip 54 of saw bar 14 inserted into the log the distance permitted by tip bracket 55 to make a guide groove or channel 70 about 5 centimeters deep and corresponding in width to the dimension of the cutter teeth 30. The chalk line 51 is preferably made along the longitudinal axis of the log 50 so that the guide channel 70 will extend along the longitudinal axis of the log 50.

Figure 7:
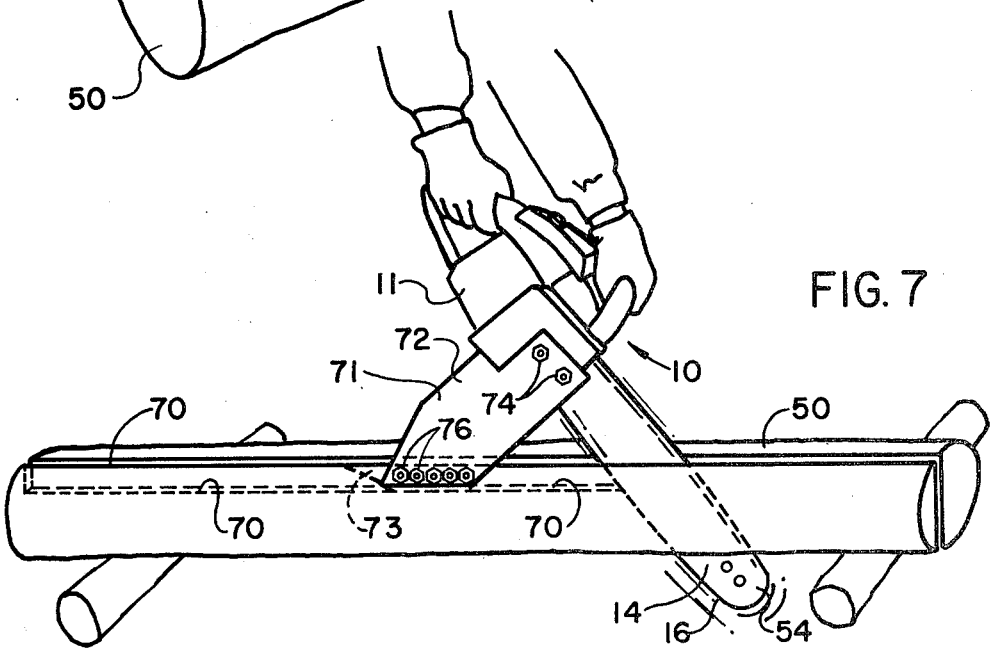
FIG. 7 is a perspective view of the grooved log of FIG. 6 being split by the chain saw after removal of the tip bracket and the mounting of the stabilizing bracket.
Figure 10:
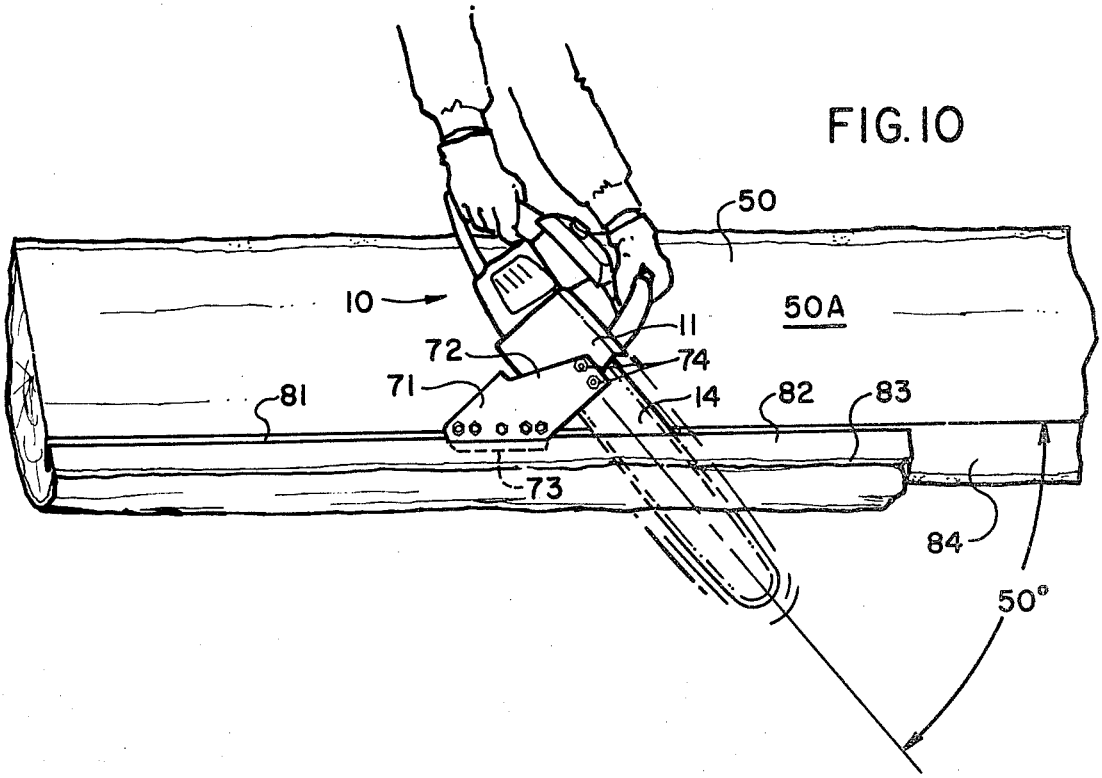

The next step in the novel method of this invention is to split the log in half using the straight line defined by the guide channel 70 to guide the chain saw in a straight cut. The invention insures a straight cut by providing a stabilizing bracket or stabilizer 71 (FIGS. 7, 10 and 11) comprising a mounting plate 72 and a guide finger 73 supported in offset relation to the plane of the mounting plate 72. The mounting plate 72 of stabilizer 71 is attached to the housing 11 of chain saw 10 by the usual bolts 74 which attach saw bar 14 to housing 11 (FIGS. 7 and 10). For this purpose the mounting plate 72 is provided with bores 75 which register with the conventional openings or bores, not shown, in the saw bar 14 to receive the bolts 74. The mounting plate 72 of stabilizer 71 has a configuration in the vicinity of the bores 75 corresponding with the surface configuration of the housing 11 of the chain saw 10 in order to permit the bores 75 to register with the bores in the saw bar to receive the bolts 74 for attachment of stabilizer 71 to the fixed end of saw blade 14 and the housing 11.

Stabilizer 71 extends in diverging relation from the saw bar 14, and the end of the mounting plate 72 remote from the bores 75 is provided with additional bores, not shown, for the reception of bolts 76 for attachment of guide finger 73 to mounting plate 72. The bolts 76 also penetrate a spacer 77 (see the end elevation on the right side of FIG. 11), and the spacer 77 and bolts 76 support the guide finger 73 in fixed offset relation to the mounting plate 72 and in the same plane as occupied by saw bar 14. The guide finger 73 has a thickness dimension no larger than the kerf of the cut made by the saw chain 16 in forming the guide channel 70.

After the guide channel 70 has been formed as described the log is cleanly split in half by attaching the stabilizer 71 to the chain saw in the manner described and positioning the guide finger 73 in the guide channel 70 with the saw bar 14 overhanging one end of the log and in alignment with the guide channel 70 along the longitudinal axis of the log 50. So positioned, the spacer 77 rests on the surface of the log adjoining the guide channel 70 (FIG. 7). The lower end of the mounting plate 72 terminates along an angular line 78 which overlaps the spacer 77 and proximal edge 79 of guide finger 73 (FIG. 11). The line 78 also defines the lower edge of spacer 77 in FIG. 11 and as seen in FIG. 7 the line 78 and correspondingly the guide finger 73 and lower edge of spacer 77 extend at an obtuse angle of about 130° from saw bar 14. So positioned the stabilizer 71 serves to effectively increase the width of the saw bar 14 from, for example, 9 centimeters to 37 centimeters, correspondingly increasing the stability of the chain saw and the capability of the operator to cut a straight line to split the log in half with the chain saw and its improved stabilizer.

Figure 8:
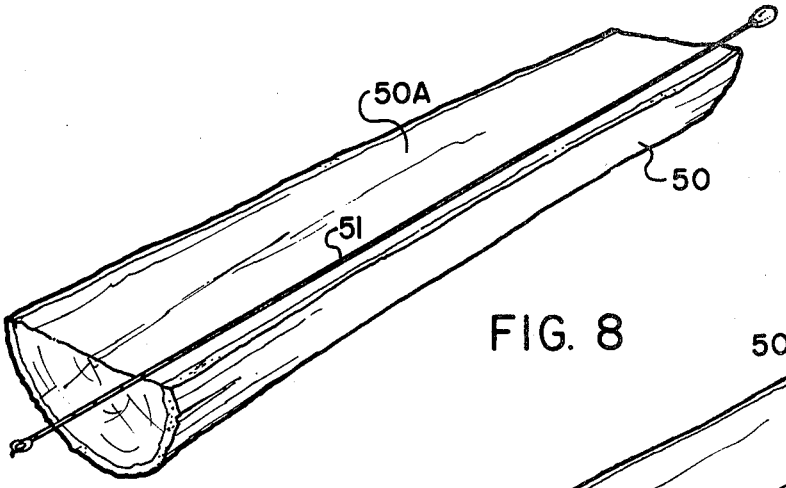
FIGS. 8, 9 and 10 are sequential perspective views of the log of FIG. 6 after it has been split and illustrating in FIG. 8 the use of a chalk line to designate the path of a guide channel, in FIG. 9 the cutting of the guide channel with the chain saw and tip bracket attached, and in FIG. 10 the cutting of a slab with the stabilizing bracket guiding the saw along the guide channel.
Figure 9:
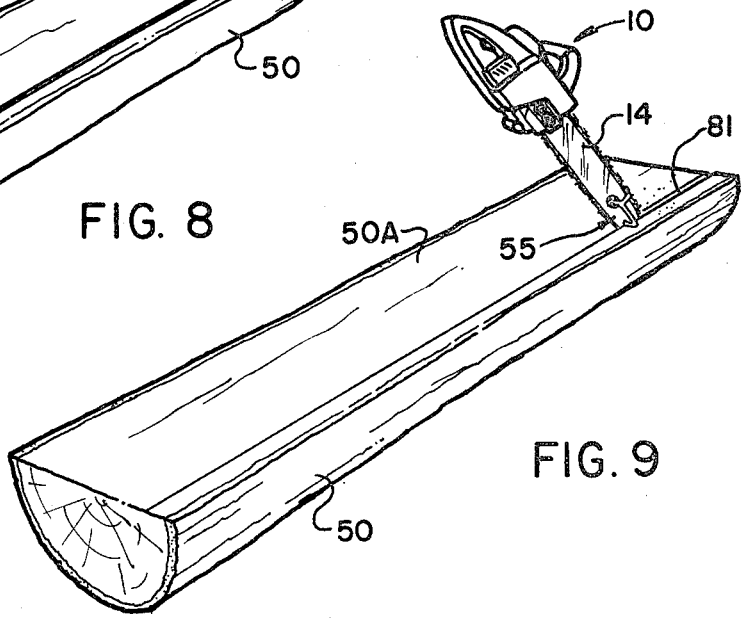

The next step in converting the log 50 into lumber or boards according to the invention is to mark along a split surface 50A of the log 50 a line designating the path of cut for the first slab cut from the log. The line may be made at a desired distance from one longitudinal edge of the log 50 by a chalk line 51 in the same manner as the uncut log was previously marked provide a visible line 80 along one longitudinal edge of the log 50 (FIGS. 8 and 9). The tip bracket 59 is again assembled on the tip 54 of saw bar 14 and a second guide channel 81 is cut along line 80 in the same manner as guide channel 70 was cut (FIG. 6).

Thereafter, the stabilizer 71 and its guide finger 73 is utilized to cut the first slab 82 (FIG. 10) in the same manner as described in splitting the log in half (FIG. 7). The cutting of the first slab 82 and its accompanying layer of bark 83 leaves a straight edge 84 which serves as an effective guide to cut straight boards from the log 50 with the chain saw 10 when it is equipped with the guide bracket 85 (FIG. 12). The stabilizer 71 must be removed from the chain saw before the guide bracket 85 can be attached because the guide bracket 85 is attached to the chain saw with the same bolts 74 that connect the stabilizer to the saw bar 14 and housing 11.

Figure 15A:
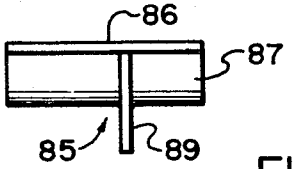
FIGS. 15A, 15B and 15C are, respectively, a top plan view, a rear elevation and a side view of a non-adjustable guide bracket.
Figure 15C:
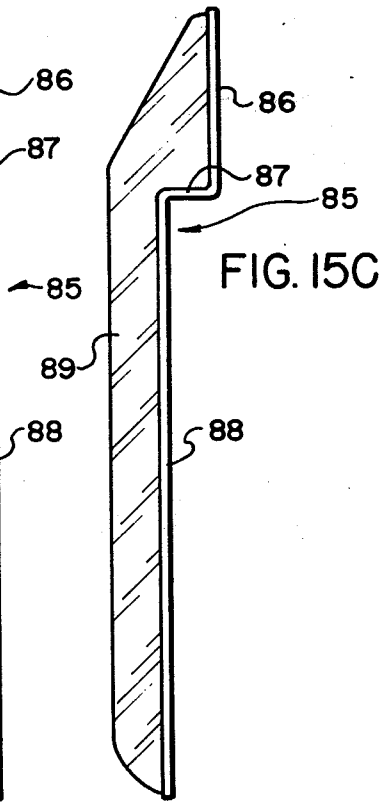
Figure 15B:
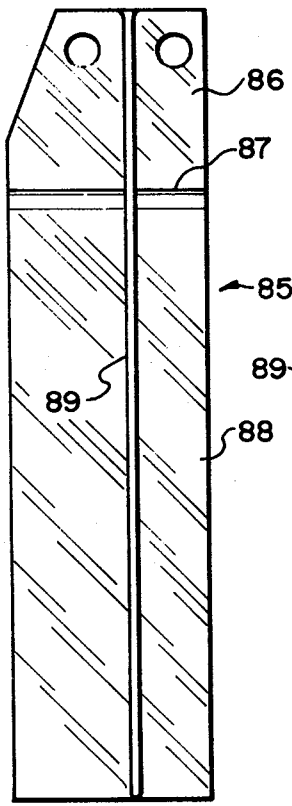
Figure 14:
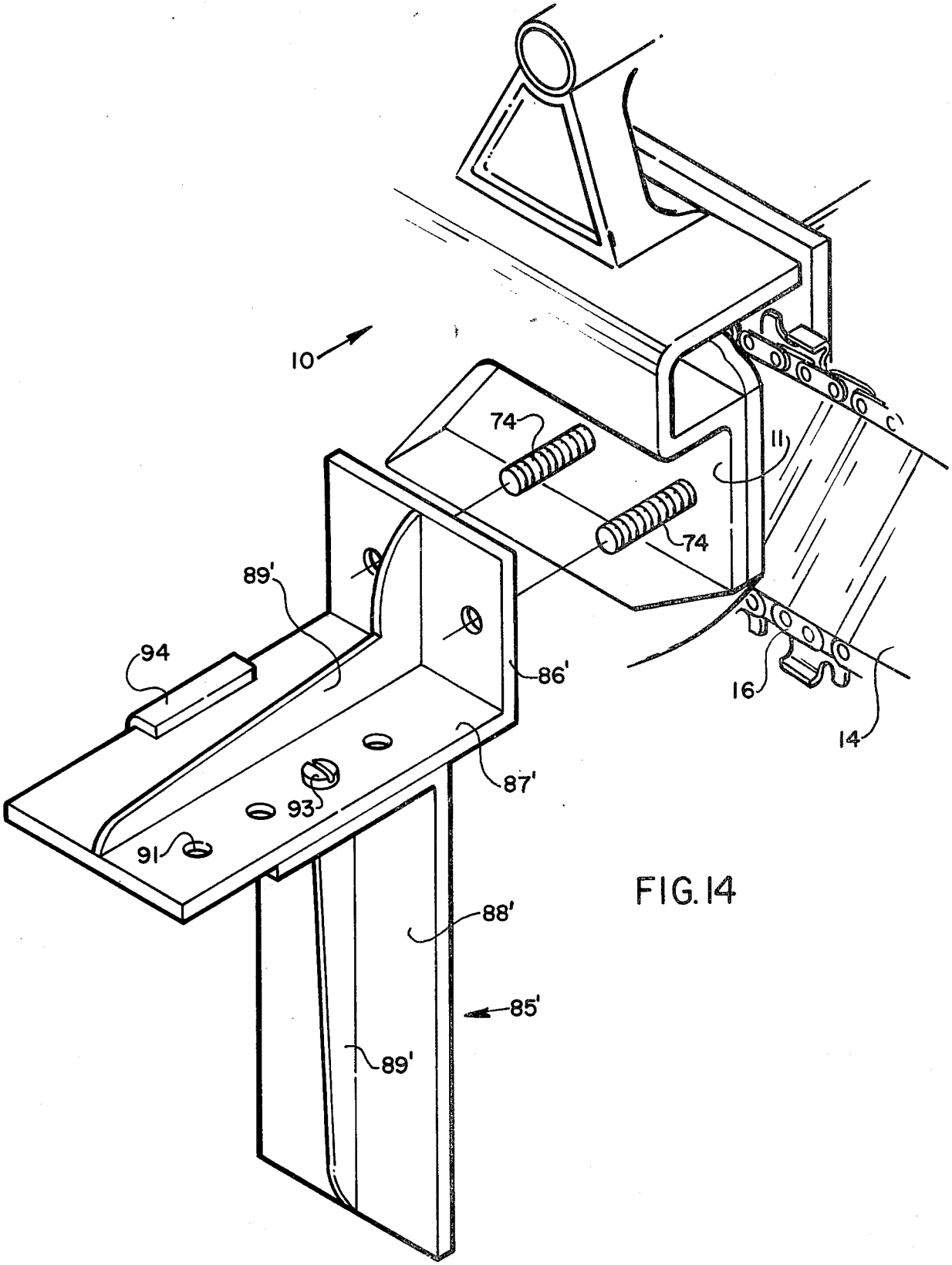
FIG. 14 is a fragmentary exploded view illustrating the attachment of the adjustable guide bracket to the housing of a chain saw.

The guide bracket 85 includes a mounting plate 86, a shoulder 87 depending in right angular relation from the mounting plate 86 and a guide leg 88 depending in right angular relation from the end of the shoulder 87 remote from the mounting plate 86. As most clearly seen in FIG. 15C the mounting plate 86 and guide leg 88 extend in spaced parallel relation to each other and are maintained in this relation by the integrally formed shoulder 87. A reinforcing flange 89 preferably extends longitudinally of guide bracket 85.

The mounting plate 86 is offset outwardly from the saw bar 14 and the guide leg 88 is further offset from the saw bar 14 a desired distance. The distance between the saw bar 14 and guide leg 88 is equal to the dimension of the board to be cut from log 50. For example, assuming the distance between the mounting plate 86 and the saw bar 14 is 1.25 centimeters and it is desired to cut a board from log 50 having a thickness of 5 centimeters, the shoulder 87 will be 3.75 centimeters long to space the guide leg 88 the desired 5 centimeters from the saw bar 14. A board 90 of the desired thickness, such as 5 centimeters, is cut by pressing against the straight edge 84 with the shoulder 87 resting on top of the split surface 50A of log 50 in FIG. 12.

Figure 13A:
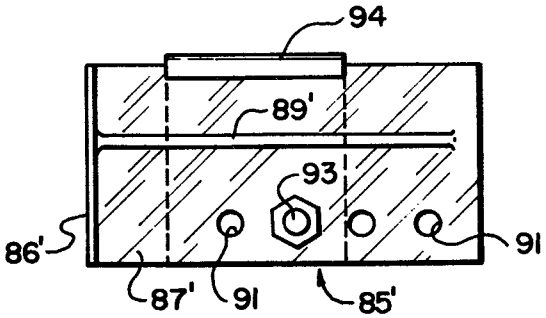
FIGS. 13A, 13B and 13C are, respectively, a top plan view, a side view and a rear elevation of an adjustable guide bracket.
Figure 13B:
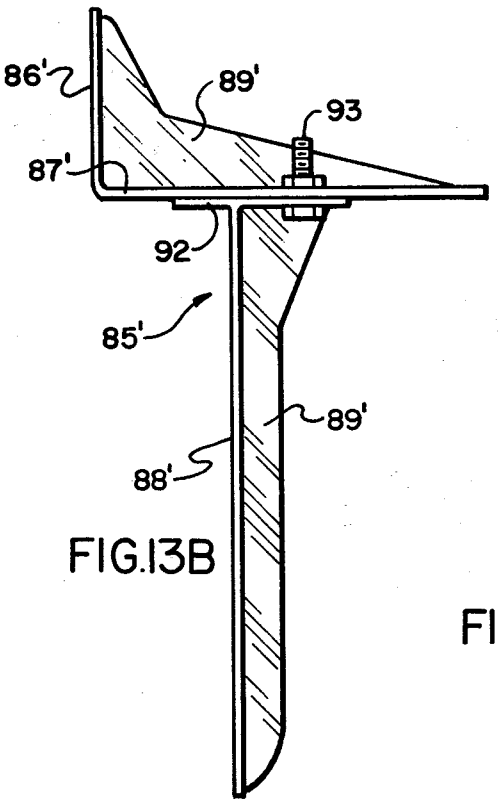
Figure 13C:
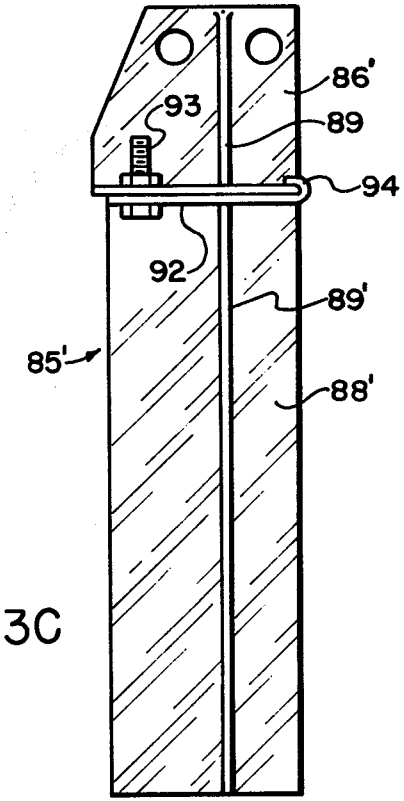

The shoulder 87 on cutter bracket 85 may be made in varying dimensions to cut varying widths of boards from log 50. It is also contemplated that the cutter bracket may be made adjustable by providing means to vary the effective length of the shoulder between the mounting plate and the guide leg. An adjustable cutter bracket 85' is illustrated in FIGS. 13A–13C which is so similar in construction to cutter bracket 85 that a further description is deemed unnecessary except for the adjustable mechanism, it being noted that like parts of the cutter bracket 85 and adjustable bracket 85' bear like reference characters with the prime notation added to the reference characters for the adjustable bracket 85'.

The shoulder 87' of cutter bracket 85' is elongated to provide the requisite dimension of the widest board desired to be cut from log 50. The mounting plate 86' is formed separately from the guide leg 88' in the adjustable cutter bracket 85' in order to permit movement of guide leg 88' relative to mounting plate 86'. As most clearly seen in FIG. 13A shoulder 87' is provided with a plurality of bores 91 spaced apart in the example shown to provide four different widths of boards.

The guide leg 88' includes a right angular flange 92 which has a single bore therethrough which may be registered with any desired bore 91 in shoulder 87' preparatory to connecting the guide leg 88' to the shoulder 87' with a bolt and nut 93. The other end of flange 92 is connected to the shoulder 87' by an upwardly and inwardly turned lip 94 which extends over the edge of the shoulder 87' opposite the bores 91. The guide leg 88' may be quickly and easily removed from the shoulder 87' and reattached using a selected bore 91 to cut a board of a different thickness when desired.

After the board 90 is cut from log 50 in FIG. 12 the adjustable guide bracket 85' or a non-adjustable guide bracket 85 having a shoulder 87 of a desired dimension can be used to cut the bark 83 from the edge of the board to finish the job.

In the drawings and specification there has been set forth a preferred embodiment of the invention and although specific terms are employed they are used in a descriptive and generic sense only.

I claim:

1. The method of cutting boards of lumber from a log with a portable chain saw having a saw bar and cutting chain, said method comprising the steps of:

(a) providing a visible line on the surface of the log substantially parallel with the longitudinal axis of the log;

(b) cutting a guide channel of a predetermined depth in the log along the visible line;

(c) positioning the saw bar within the guide channel at one end of the log and stabilizing the saw bar within the guide channel while moving the chain saw longitudinally of the log to split the log;

(d) providing a second visible line along one longitudinal edge of the split surface of the log in offset relation to the axis of the log;

(e) defining a second guide channel along said second visible line;

(f) positioning the saw bar in the guide channel at one end of the log and stabilizing the saw bar within the guide channel while drawing the chain saw along the length of the log to simultaneously cut a first slab from the log and define a straight edge on the log;

(g) guiding the chain saw along said straight edge with the saw bar spaced inwardly from said straight edge to cut a board.

2. In combination with a chain saw having a saw bar and a cutting chain for cutting boards from logs, the combination of:

(a) means for cutting a guide channel of a predetermined depth longitudinally of the log, (b) stabilizing means removably attached to the fixed end of the saw bar and engagable with said guide channel for guiding the path of the chain saw while cutting a straight edge along one longitudinal extent of the log, (c) and guide means removably attached to the fixed end of the saw bar and engagable with the straight edge on the log to guide the chain saw along a predetermined path longitudinally of the log and parallel with said straight edge to cut a board from the log.

3. A structure according to claim 2 wherein said stabilizing means includes a mounting plate for attachment to the fixed end of the saw bar in angular relation thereto and extending rearwardly from the saw bar, and a guide finger spaced inwardly from the mounting plate and occupying the same plane as the saw bar for engagement with a groove in a log immediately beneath the saw bar.

4. A structure according to claim 3 wherein the stabilizing means includes a spacer between the mounting plate and the guide finger, said spacer resting on the surface of the log in operation.

5. Apparatus according to claim 3 wherein said guide means is adjustable to guide the saw bar longitudinally of the log in desired spaced relation to the straight edge.

6. A stabilizing bracket for attachment to a chain saw having a housing, a saw bar and a cutting chain, said stabilizing bracket comprising a mounting plate attached to the fixed end of the saw bar with the same means that attach the saw bar to the chain saw, said mounting plate extending from the saw bar in angular relation thereto and rearwardly therefrom and said mounting plate terminating along a line extending at an obtuse angle rearwardly of the saw bar, a guide finger connected to the terminal end of the mounting plate, and means spacing the guide finger inwardly of the mounting plate to support the guide finger in the same plane occupied by the saw bar.

7. A structure according to claim 2 wherein the guide means is of monolithic construction and includes a mounting plate removably attached to the fixed end of the saw bar, a shoulder projecting outwardly from the lower end of the mounting plate away from the chain saw, and a guide plate depending from the outer end of the shoulder and extending downwardly therefrom in fixed parallel spaced relation to the mounting plate.

8. A structure according to claim 7 wherein the mounting plate extends in spaced parallel relation to the saw bar.

9. Apparatus according to claim 5 wherein the adjustable guide means comprises a mounting plate for removable attachment to the fixed end of the saw bar in spaced parallel relation thereto, a shoulder formed integral with the mounting plate and extending perpendicularly therefrom outwardly from the chain saw, said shoulder having a plurality of bores spaced from each other along one longitudinal edge of the shoulder, a guide plate depending from the shoulder and including a mounting flange parallel with the shoulder and a guide plate depending from the shoulder and including a mounting flange parallel with the shoulder and a guide leg formed integrally with the mounting flange in right angular relation thereto, said mounting flange having a bore spaced inwardly from one lateral edge of the mounting flange and said bore being selectively registrable with one of the bores in the shoulder to receive a bolt for attachment of the mounting flange to the shoulder, and an upturned lip on the lateral edge of the mounting flange opposite said bore, said lip extending about the edge of the shoulder opposite the bores to releasably connect the proximal edges of the shoulder and mounting flange together.

10. A structure according to claim 2 wherein said first named means includes a tip bracket removably attached to the tip end of the saw bar and extending laterally therefrom to limit the depth of cut.

11. A structure according to any of the preceding claims 2–10 wherein the cutting chain includes cutting teeth each having a straight chisel shaped leading edge extending perpendicular to the path of the cutting chain.

12. A cutting chain according to claim 11 wherein the cutting tooth comprises a solid chisel shaped body portion including a sharpened leading edge and said body portion tapering outwardly and rearwardly from the leading edge, and a pair of laterally spaced legs extending from the body portion and means connecting the legs on opposite sides of the cutter chain with the body portion of the cutting tooth straddling the cutter chain.

* * * * *